United States Patent [19]

Ramisch et al.

[11] Patent Number: 4,687,275

[45] Date of Patent: Aug. 18, 1987

[54] ELECTRICAL CONNECTOR FOR FLAT MULTICONDUCTOR CABLE

[75] Inventors: Hans Ramisch, Mühldorf; Gerhard Neumann, Waldkraiburg, both of Fed. Rep. of Germany

[73] Assignee: Otto Dunkel GmbH Fabrik für elektrotechnische Geräte, Mühldorf, Fed. Rep. of Germany

[21] Appl. No.: 803,211

[22] Filed: Nov. 27, 1985

[30] Foreign Application Priority Data

Nov. 27, 1984 [DE] Fed. Rep. of Germany ..... 3443235

[51] Int. Cl.[4] ..... H01R 4/24

[52] U.S. Cl. ..... 439/404

[58] Field of Search ..... 339/97 R, 97 P, 98, 339/99 R

[56] References Cited

U.S. PATENT DOCUMENTS

| | | |
|---|---|---|
| 3,990,767 | 11/1976 | Narozny . |
| 4,025,141 | 5/1977 | Thelissen . |
| 4,143,935 | 3/1979 | Goodman et al. . |
| 4,147,399 | 4/1979 | Moser et al. . |
| 4,253,722 | 3/1981 | Fox, Jr. . |
| 4,311,356 | 1/1982 | Levitt . |
| 4,351,582 | 9/1982 | Emerson et al. . |
| 4,381,132 | 4/1983 | Tournier . |
| 4,418,977 | 12/1983 | O'Shea, Jr. . |
| 4,428,637 | 1/1984 | Worth . |
| 4,437,723 | 12/1980 | Narozny ..... 339/99 R |

FOREIGN PATENT DOCUMENTS

| | | |
|---|---|---|
| 0043183 | 1/1982 | European Pat. Off. . |
| 2906021 | 12/1979 | Fed. Rep. of Germany . |
| 8107135 | 8/1981 | Fed. Rep. of Germany . |
| 8137927 | 2/1983 | Fed. Rep. of Germany . |
| 2738869 | 3/1985 | Fed. Rep. of Germany . |
| 2083292 | 3/1982 | United Kingdom . |
| 2101422 | 1/1983 | United Kingdom . |

*Primary Examiner*—Joseph H. McGlynn

*Attorney, Agent, or Firm*—Spencer & Frank

[57] ABSTRACT

A connector, for a multiconductor flat cable, composed of three rows of connection contacts mounted at a defined distance from one another in an elongate body of insulating material, with the connection contacts having the shape of sockets or pins which extend toward one surface or side of the insulating body. The connection contacts are each connected, via a center connecting section, with respective conductor terminals which are spaced slightly differently from one another than the associated connection contacts and each has the shape of a pair of contact fingers which extend approximately mutually parallel toward the opposite side or surface of the insulating body. The conductor terminals are longitudinally located such that each conductor of the flat cable will be pressed between a respective pair of contact fingers so as to pierce or displace the insulation surrounding the conductor and contact same. The conductor terminals associated with the connection contacts in the two outer rows of connection contacts, as well as the conductor terminals associated with the connection contacts in the center row of connection contacts are arranged in respective rows while lie in planes other than the planes of the three rows of connection contacts, with the two outermost rows of terminals being spaced a greater distance from one another than the planes of the two outer rows of connection contacts.

14 Claims, 4 Drawing Figures

ELECTRICAL CONNECTOR FOR FLAT MULTICONDUCTOR CABLE

BACKGROUND OF THE INVENTION

The present invention relates to an electrical connector for flat multiconductor cable. More particularly the present invention relates to a flat cable electrical connector having at least three rows of connection contacts mounted at a defined distance from one another in an elongate body of insulating material, with the contacts comprising sockets or pins which extend toward one, outer surface of the insulating body and which are each connected, by way of a respective center connecting section, with a respective conductor terminal of the insulation piercing or displacement type (IDC) which each have the shape of a pair of contact fingers extending approximately mutually parallel toward the opposite outer surface of the insulating body, and with the conductor terminals being longitudinally spaced differently from one another than the respective connection contacts and being located such that each conductor of the flat cable can be pressed between a respective pair of contact fingers and contacted by piercing the insulation surrounding the conductor.

A known 50-pole flat cable connector of the above described type, a so-called D-subminiature connector is disclosed in DE-OS No. 3,151,563 corresponding to U.S. Pat. No. 4,437,723. In this connector, the center connecting sections of each row lead from respective connection contacts in a common plane to the associated conductor terminals arranged in a corresponding row and also located in the common plane. That is, in the known connector, three parallel planar rows of contact elements are provided with each of the two outer rows having 17 connection contacts and an associated outer row of 17 conductor terminals extending in a common plane, while the center row has 16 connection contacts and 16 conductor terminals which extend in a common plane parallel to and between the planes of the connection contacts and conductor terminals of the two outer rows. Although this D-connector structure for flat cable connections permits economical manufacture in that the three rows of contact elements, which each comprise a connection contact, a central connecting station and a conductor terminal of the insulation displacement type, can be cut out of three identically shaped strips of contact metal which have previously been attached to one surface of a respective flat insulating carrier or support, this connector has the drawback that, due to the close arrangement of the contact elements, very little contact metal strip material is available for forming the connection contacts. For example, there is not sufficient material to configure at least the socket type connection contacts in the form of tubes or sleeves. Rather, it is merely possible to form elastic tongues which are arranged next to one another like the teeth of a comb and which are each able to form a current transfer point with the associated countercontact only from one side. This type of current transfer leaves something to be desired, particularly when vibrations or shocks act on the connector. A further drawback of this known connector caused by the close arrangement of the contact elements in the connector is the danger of interfering with the dielectric material between successive adjacent contact elements resulting in breakdowns or short circuits.

It should be noted that in order to avoid the above-mentioned drawbacks of the above described prior art flat cable connector wherein the connecting elements (each including a connection contact, a center connecting section and an IDC conductor terminal) of each row are arranged on one of the two surfaces of a flat insulating carrier which supports these contact elements in the connector, it has already been proposed to bring the center connecting sections and the IDC conductor terminals out of the plane of the connection contacts by a small step and to mount them in alternating sequence on one of the two opposed outer surfaces of the flat insulating carrier. Due to this alternating arrangement, greater spaces exist between adjacent contact elements, and in particular, the center connecting sections and the conductor terminals, and therefore better dielectric action. Moreover, as a result of the manner in which the contact elements are formed, more contact metal is available for each contact element for forming the connecting contacts. Consequently, the latter need no longer be provided in the form of tongues which form a current transfer point with the countercontact only from one side. Rather, the connecting contacts can be provided with the configuration of tubular sockets or sleeves which assure proper current transfer. The above-mentioned advantages of this latter prior art embodiment, however, must be paid for by a significantly more complicated manufacturing process. In particular, the individual contact elements cannot, as in the previously known embodiment, be cut out of a single contact metal strip after it has been applied to the surface of the insulating support so that the contact elements are immediately provided in a suitable form and at the correct location. Instead, the individual contact elements must first be cut out of a sheet metal strip and then must be applied to one of the two sides of the insulating carrier.

It must further be pointed out that a flat cable connector is already known (German Patent No. 2,738,869) wherein a plurality of connection contacts are each connected with IDC conductor terminals by way of differently bent connecting arms which serve to compensate for the different distances between the connection contacts on the one hand and the conductor terminals on the other hand. This prior art flat cable connector, however, is designed to have a maximum of only two rows and its structural configuration cannot be transferred to connector devices with more than two rows.

SUMMARY OF THE INVENTION

It is an object of the present invention to provide a further improved flat cable connector of the above-mentioned general type in which good current transfer is assured even under shocks and wherein the danger of interference with the dielectric material is avoided.

The above object is achieved according to the present invention by a flat cable connection of the above described type wherein: the conductor terminals associated with the connection contacts in the outer rows as well as the conductor terminals associated with the connection contacts in the center row are arranged in rows which lie in planes other than the planes of the three rows of connection contacts; the two outermost rows of conductor terminals are at a greater distance from one another than the distance between the planes of the two outer connection contact rows; the center connecting sections for the conductor terminals and their associated connection contacts are each formed by a respective contact tab which extends transversely to the longitudinal axis of the associated connection contact; and, in each row, each contact tab forms an angle with the longitudinal axis of the surface of the insulating body, with the angle, starting at the center of the insulating body, decreasing toward each of the two ends of the insulating body.

In this connector, in which the contact tabs extend transverse to the longitudinal axes of the connection contacts and thus provide greater distances between the conductor terminals, it is possible to produce higher quality socket and pins as connection contacts which ensure proper current transfer even when there are shocks. Moreover, the thus obtained distribution over a larger area results in an improvement of the dielectric action between conductor terminals.

With respect to an enlargement of the mutual spacing between conductor terminals, it was found to be particularly advisable, according to a feature of the invention, to distribute the conductor terminals associated with the connection contacts in the center row over two rows whose mutual spacing is less than the distance between the two outer rows of conductor terminals but greater than the mutual distance between the two outer rows of connection contacts. In this arrangement, the connection contacts distributed over the three rows change to four rows of conductor terminals in a distribution with greater distances between the conductor terminals.

According to a further feature of the invention, a particularly economical manufacturing process is realized, with nevertheless good insulating properties of the connector, if the contact tabs emanating from the connection contacts of the two outer rows of connection contacts extend in a first plane which forms a right angle with the axes of the connection contacts, while the contact tabs extending from the connection contacts of the center row of connection contacts extend in a second plane parallel to the first plane, and an insulating insert is provided in the insulating body to assure the mutual spacing between contact tabs which extend in the two different planes. Preferably, the first plane is adjacent the outer surface of the insulating body containing the connection contacts while the second plane is disposed between the first plane and the opposite outer surface of the insulating body. In this way, it is possible to initially arrange the contact elements of the outer rows within the insulating body or housing and then, before installing the contact elements of the center row, install the insulating insert which assures proper insulation between the contact tabs in both planes of contact tabs.

According to the preferred embodiment of the invention, the insulating body includes a housing which has a U-shaped cross section and whose bottom outer surface is provided with openings through which the connection contacts extend, the insulating insert is disposed in the housing, the insulating insert is provided, on its surface facing the housing bottom, with slit-like recesses for the accommodation of the angularly oriented contact tabs for the connection contacts disposed in the outer rows, and the insulating insert is also provided, on its surface facing away from the housing bottom, with slit-shaped recesses for the accommodation of the angularly oriented contact tabs for the connection contacts disposed in the center row.

A connector comprising the structural particularities described above can be produced in two ways. According to a first, and preferred arrangement, contact tabs are employed whose length, starting at the center of the insulating body, increases towards both ends, with the conductor terminals of each row being oriented in a straight line with respect to one another. Alternatively, it is also possible to make the contact tabs for the conductor terminals of each row of the same length. This latter arrangement can be realized by arranging the conductor terminals of each row in a straight line with respect to one another and causing the contact tabs leading toward these conductor terminals to have a greatly curved configuration, with the curvature beginning in the center of the insulating housing and decreasing toward both of its ends. Alternatively, it is possible, in order to avoid or reduce the curvature of the contact tabs, to arrange the conductor terminals of each row in an arc such that, starting from a maximum mutual spacing in the center of the housing of insulating material, the contact tabs come closer to the conductor terminal locations towards the end of the housing.

DETAILED DESCRIPTION OF THE PREFERRED EMBODIMENT

Figure 1:
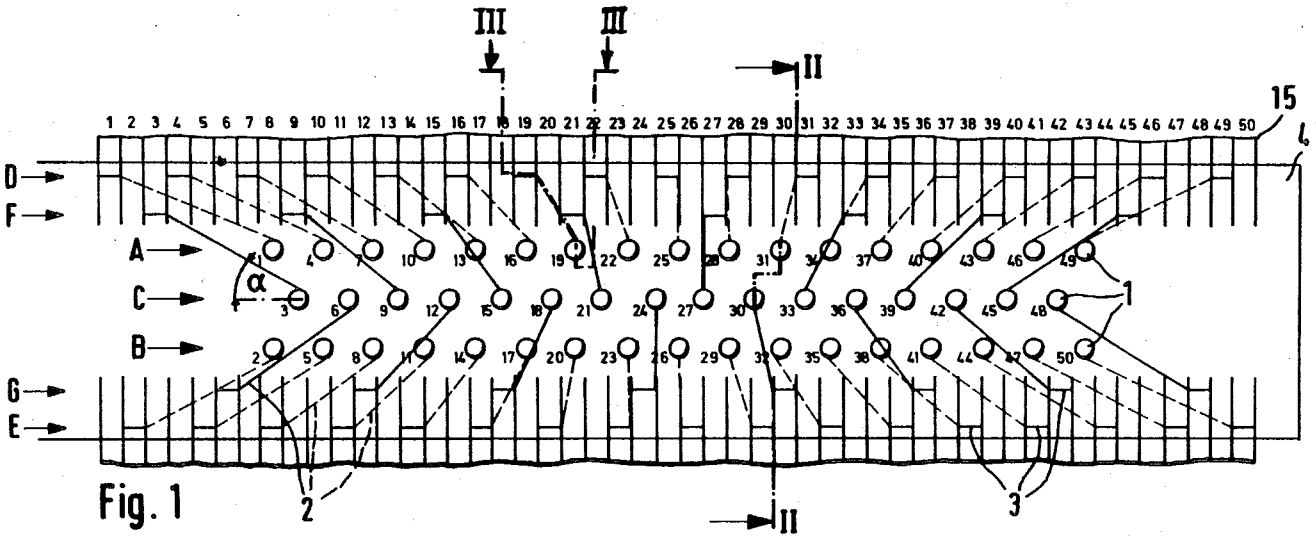
FIG. 1 is a schematic plan view of a 50-pole three-row connector according to the invention.
Figure 2:
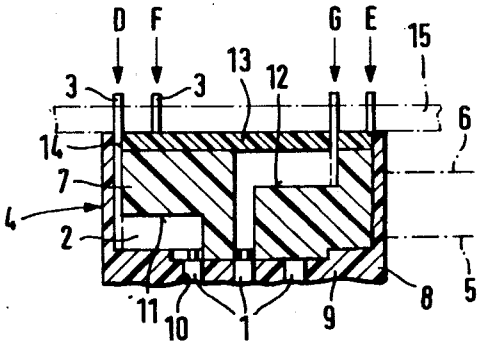
FIG. 2 is a sectional view along line II—II of FIG. 1.

As can be seen in the drawing figures, the connector, which on one surface is designed as a standard 50-pole D-subminiature connector, is composed of three rows A, B and C of connection contacts 1, which may be in the form of pins or in the form of sockets as shown, and which are each connected by means of a respective center connecting section 2 with a respective conductor terminal 3 of the insulation displacement type. The contact elements of the connector, which each comprise a connection contact 1, a connecting section 2 and a conductor terminal 3, are accommodated in an insulating body 4. The conductor terminals 3 are disposed in the insulating body 4 such that they extend through the surface of the body 4 opposite that at which the connection contacts 1 are located (FIG. 2). Moreover, as shown in FIG. 1, the conductor terminals 3 are disposed such that their mutual spacing is different than that of the connection contacts 1 and such that each conductor terminal 3 is located at a different longitudinal position whereat it will be associated with a different respective conductor of a 50-conductor flat cable 15. In a known manner, the conductor terminals 3 each include, as shown in FIG. 3, a pair of mutually parallel extending contact fingers 3' between which one conductor 15' of a flat cable 15 can be pressed by piercing the insulation 16 surrounding the conductor.

In the illustrated 50-pole connector, the connection contacts 1 are arranged in the conventional manner with seventeen connection contacts 1 being disposed in two parallel symmetrically arranged outer rows A and B and with sixteen connection contacts 1 being disposed in a straight center row C. The connection contacts 1 of the two outer rows A and B each have an associated straight row D and E, respectively, of connection terminals 3, with each row having seventeen terminals 3. However, the center row C of connection contacts 1 is preferably associated, as shown, with two rows F and G of conductor terminals 3, with each row having eight conductor terminals 3. As can be seen in FIG. 1, the spacing between successive conductor terminals 3 of each row D, E, F and G is preferably constant but with the spacing in rows D and E being different than the spacing in rows F and G. As can further be seen in FIG. 1, rows D and E of conductor terminals 3, which are associated with the connection contacts 1 disposed in the two outer rows A and B, and rows F and G of conductor terminals 3, which are associated with the connection contacts 1 in center row C, each lies in a respective plane which is different than any of the planes of the three rows A, B and C of connection contacts 1. Moreover, the two outermost rows D and E of conductor terminals have a greater mutual spacing than the two outer rows A and B of connection contacts 1, while the two rows F and G of conductor terminals 3, which are associated with connection contacts 1 of the center row C, have a mutual spacing which is less than the spacing between the outer two rows D and E of conductor terminals 3 but greater than the mutual spacing between the two outer rows A and B of connection contacts 1. As shown in FIGS. 1–3, the center connecting sections 2 for connecting the conductor terminals 3 with their associated connection contacts 1 are each formed by a respective contact tab which extends transversely to the longitudinal axis of the associated connection contact 1. As can be seen in FIG. 1, in each row the contact tabs 2 each form an angle $\alpha$ with the longitudinal axis of the surface of the body 4 (as well as with the longitudinal axis of the associated connection contact 1), with the angle $\alpha$ having a maximum value (approximately 90°) at the center of the insulating body 4 and decreasing toward both ends of the insulating body 4.

Figure 3:
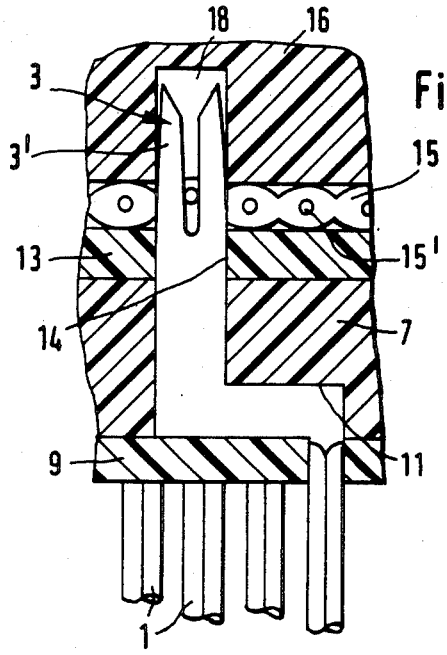
FIG. 3 is a partial sectional view along line III—III of FIG. 1.

Referring now specifically to FIGS. 2 and 3, insulating body 4 is shown as comprising a housing 8 which has a U-shaped cross section and which is provided with openings 10 through its bottom surface 9 for the passage of the connection contacts 1. Additionally, as shown, the contact tabs 2 associated with the two outer rows A and B of connection contacts 1 and the two outer rows (D and E) of conductor terminal 3 lie in a different plane extending perpendicular to the longitudinal axes of the connection contacts 1 than the contact tabs 2 associated with the two inner rows F and G of conductor terminals 3 and the center row 6 of connection contacts 1. As shown, the contact tabs 2 (shown by dashed lines in FIG. 1) associated with the outer rows A and B of connection contacts 1 lie in a plane 5 which is adjacent to the bottom surface 9 and forms a right angle with the longitudinal axes of the connection contacts 1, while the contact tabs 2 (shown in solid line in FIG. 1) associated with the center row C of connection contacts 1 and the two inner rows F and G of conductor terminals 3 lie in a plane 6 which is parallel to the plane 5 and disposed between the plane 5 and the back or opposite surface of the housing 8. In order to assure the mutual spacing between the contact tabs 2 in the two planes 5 and 6, an insulating insert 7 is provided in the housing 8 between the two planes 5 and 6. Preferably, as shown, the insulating insert 7 extends into the two planes 5 and 6 and is provided, on its side or surface facing the housing bottom surface 9, with slit-shaped recesses 11 for the angularly oriented accommodation of the contact tabs 2 for the connection contacts 1 disposed in the outer rows A and B. Moreover, on its side or surface facing away from housing bottom surface 9, the insulating insert 7 is provided with slit-shaped recesses 12 for the angularly oriented accommodation of the contact tabs 2 for the connection contacts 1 disposed in center row C. Finally, the housing 8 further has an associated cover plate 13 which is provided with a plurality of slit-shaped openings 14 through which extend the respective conductor terminals 3.

In the embodiment shown in FIGS. 1–3, beginning approximately in the center of insulating body 4, the length of the contact tabs 2 increases toward both ends of the insulating body 4. In each row D, E, F and G, the conductor terminals 3 are aligned with respect to one another in a straight line.

In a deviation from the illustrated embodiment, it is possible according to a modified embodiment of the invention, to provide contact tabs 2 of identical length for the conductor terminals 3 of each row D, E, F and G of conductor terminals. In such case, the conductor terminals 3 of each row may be oriented in a straight line with respect to one another, and the contact tabs 2 leading to them may have a curved configuration, with the curvature being a maximum in the center of the insulating housing 4 and decreasing toward both ends. In a further variation, in order to avoid or reduce the curvature of the contact tabs 2, the conductor terminals 3 of each row are arranged in an arcuate pattern such that, starting from a maximum mutual distance in the center of the insulating housing 4, the conductor terminals 3 approach one another toward the ends of the housing.

Figure 4:
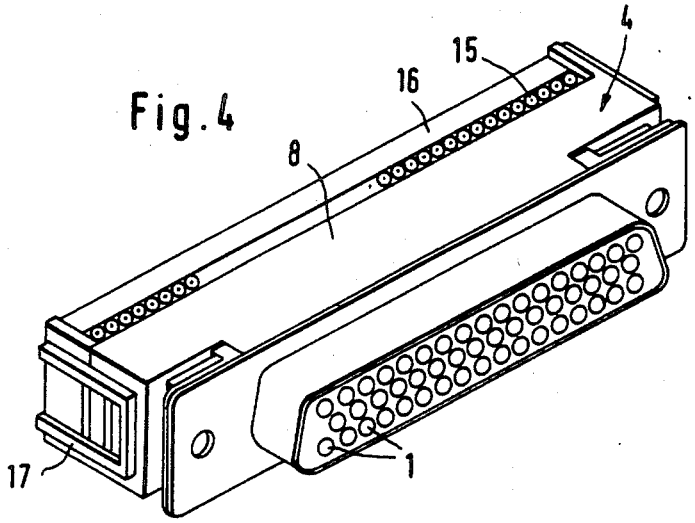
FIG. 4 is a perspective view of the 50-pole flat cable connector schematically shown in FIG. 1.

As shown in FIGS. 2 to 4, the connector according to the invention is secured and connected to a 50-conductor flat cable 15 in a known manner by means of a back plate 16 which is secured to the housing 4 by means of snap connections 17 and which clamps the cable 15 against the outer surface of the cover 13 and simultaneously forces each conductor of the cable 15 into engagement with an aligned one of the conductor terminals 3 to provide electrical contact. The inner surface of the back plate 16 is provided with a plurality of longitudinally extending grooves 18 which are aligned respectively with the rows D, E, F, G of conductor terminals 3 so as to receive the portions of the contact fingers 3' which extend beyond the cable 15 (FIG. 3).

It will be understood that the above description of the present invention is susceptible to various modifications, changes and adaptations, and the same are intended to be comprehended within the meaning and range of equivalents of the appended claims.

What is claimed is:

1. In an electrical connector for a flat multiconductor cable, wherein said electrical connector has at least three rows of connection contacts mounted at a defined distance from one another in an elongate body of insulating material, said connection contacts comprise sockets or pins which extend toward one, outer surface of said insulating body, said connection contacts are each connected, via a respective center connecting section, with a respective conductor terminal of the insulation displacement type which each have the shape of a pair of contact fingers extending approximately mutually parallel toward the opposite outer surface of said insulating body, and said conductor terminals are longitudinally spaced differently from one another than the associated connection contacts and are located such that each conductor of the flat cable can be pressed between a respective pair of said contact fingers and contacted by piercing the insulation surrounding the conductor; the improvement wherein: said conductor terminals associated with the connection contacts in the outer rows of conductor terminals and said conductor terminals associated with said connection contacts in the center row of connection contacts are arranged in respective rows which lie in planes other than the planes of the three rows of connection contacts; the two outermost rows of conductor terminals are at a greater distance from one another than the distance between the planes of said two outer rows of connection contacts; said center connecting sections for said conductor terminals and their associated said connection contacts are each formed by a contact tab which extends transversely to the longitudinal axis of the associated said connection contact; and, in each row of connection contacts, each said contact tab forms an angle with the longitudinal axis of said one surface of said insulating body, with said angle, starting at the center of said insulating body surface, decreasing toward each of the two ends of said insulating body.

2. A connector as defined in claim 1, wherein said angle has a maximum value of approximately 90° at said center of said insulating body surface.

3. A connector as defined in claim 1, wherein: the length of said contact tabs, beginning approximately in the center of said insulating body, increases toward both ends of said insulating body; and said conductor terminals in each row of conductor terminals are aligned in a straight line with respect to one another.

4. A connector as defined in claim 1, wherein: said conductor terminals associated with said connection contacts in said center row are distributed to two conductor terminal rows whose mutual spacing is less than the spacing between said two outer rows of conductor terminals but greater than the mutual spacing between said two outer rows of connection contacts.

5. A connector as defined in claim 4, wherein: said contact tabs which extend from said connection contacts of said two outer rows of connection contacts are disposed in a first plane which forms a right angle with the longitudinal axes of said connection contacts; said contact tabs which extend from said connection contacts of said center row of connection contacts are disposed in a second plane which is parallel to said first plane; and said insulating body includes an insulating means, which is disposed at least between said first and second planes, for assuring the mutual spacing between said contact tabs extending in said first and second planes.

6. A connector as defined in claim 5, wherein said first plane is disposed adjacent said one surface of said insulating body and said second plane is disposed adjacent said opposite surface of said insulating body.

7. A connector as defined in claim 6, wherein said insulating body comprises a housing having a U-shaped cross section whose bottom surface is said one surface and is provided with a plurality of openings through which respective said connection contacts extend, and an insulating insert, which constitutes said insulating means, disposed in said housing; wherein said insulating insert extends into said first and second planes: and wherein said insulating insert is provided, on its side facing said housing bottom surface, with slit-shaped recesses for accommodating the angularly oriented said contact tabs for the said connection contacts disposed in said two outer rows of connection contacts, and is provided, on its side facing away from said housing bottom surface, with slit-shaped recesses for accommodating the angularly oriented said contact tabs for the said connection contacts disposed in said center row of connection contacts.

8. A connector as defined in claim 7, wherein said U-shaped housing has an associated cover plate which is provided with slit-shaped openings through which respective said conductor terminals extend.

9. A connector as defined in claim 8, wherein: the length of said contact tabs, beginning approximately in the center of said insulating body, increases toward both ends of said insulating body; and said conductor terminals in each row of conductor terminals are aligned in a straight line with respect to one another.

10. A connector as defined in claim 4, wherein said conductor terminals associated with said connection contacts in said center row of connection contacts are uniformly distributed to said two conductor terminal rows.

11. A connector as defined in claim 10, wherein the longitudinal spacing between adjacent said conductor terminals is constant in each said row of conductor terminals, but with the said constant longitudinal spacing in said two outer rows of conductor terminals being different than said constant longitudinal spacing in the inner two rows of said conductor terminals.

12. A connector as defined in claim 1, wherein: said contact tabs which extend from said connection contacts of said two outer rows of connection contacts are disposed in a first plane which forms a right angle with the longitudinal axes of said connection contacts; said contact tabs which extend from said connection contacts of said center row of connection contacts are disposed in a second plane which is parallel to said first plane; and said insulating body includes an insulating means, which is disposed at least between said first and second planes, for assuring the mutual spacing between said contact tabs extending in said first and second planes.

13. A connector as defined in claim 12, wherein said insulating body comprises a housing having a U-shaped cross section whose bottom surface is said one surface and is provided with a plurality of openings through which respective said connection contacts extend, and an insulating insert, which constitutes said insulating means, disposed in said housing; wherein said insulating insert extends into said first and second planes; and wherein said insulating insert is provided, on its side facing said housing bottom surface, with slit-shaped recesses for accommodating the angularly oriented said contact tabs for the said connection contacts disposed in said two outer rows of connection contacts, and is provided, on its side facing away from said housing bottom surface, with slit-shaped recesses for accommodating the angularly oriented said contact tabs for the said connection contacts disposed in said center row of connection contacts.

14. A connector as defined in claim 13, wherein said U-shaped housing has an associated cover plate which is provided with slit-shaped openings through which respective said conductor terminals extend.

* * * * *